United States Patent [19]

Watanabe et al.

[11] Patent Number: 4,645,543

[45] Date of Patent: Feb. 24, 1987

[54] SUPERPLASTIC ALUMINUM ALLOY

[75] Inventors: Hideo Watanabe, Numazu; Koichi Ohori; Yo Takeuchi, both of Susono, all of Japan

[73] Assignee: Mitsubishi Aluminum Kabushiki Kaisha, Japan

[21] Appl. No.: 570,497

[22] Filed: Jan. 13, 1984

[30] Foreign Application Priority Data

Feb. 28, 1983 [JP] Japan ..... 58-32599

[51] Int. Cl.[4] ..... C22F 1/04

[52] U.S. Cl. ..... 148/2; 148/11.5 A; 148/439; 420/902

[58] Field of Search ..... 420/533, 532, 530, 902, 420/534–536; 148/2, 11.5 A, 439

[56] References Cited

U.S. PATENT DOCUMENTS 2,245,167 6/1941 Stroup ..... 148/11.5 A

*Primary Examiner*—R. Dean

*Attorney, Agent, or Firm*—McGlew and Tuttle

[57] ABSTRACT

This invention relates to a superplastic aluminum alloy comprising Mg, Cu, and at least one of Mn, Cr and Zr. The alloy has an elongation substantially of from 330% to 800% and can be readily produced.

11 Claims, No Drawings

SUPERPLASTIC ALUMINUM ALLOY

BACKGROUND OF THE INVENTION

1. Field of the Invention

This invention relates to an aluminum alloy having excellent superplasticity.

2. Description of Prior Arts

A superplastic alloy generally means an alloy which exhibits an elongation at least 300% or higher when subjected to high temperature tensile deformation at a selected temperature normally in the range of from 400° to 600° C. and at a predetermined processing speed.

As in the deformation of plastics, superplastic alloy sheet, can, for example, be blow formed by air pressure to be integrally formed into products of complicated shapes or large sizes, with the result that superplastic alloys have been used as building material panels and aircraft parts in recent years.

At present aluminum, various kinds of superplastic alloys are known, one of which alloys is a JIS(AA) 5083 alloy.

The JIS(AA) 5083 alloy has a chemical composition consisting of 4.0 to 4.9% of Mg, 0.4 to 1.0% of Mn, 0.05 to 0.25% of Cr, wherein % means % by weight, and the balance of unavoidable impurities, has excellent corrosion resistance and anodic oxidation properties, is a non-heat-treating aluminum alloy having high strength, and exhibiting a high temperature elongation of about 300% as an evaluation standard of superplasticity at an initial strain rate of $1.1\times10^{-3}$/ sec and at a deformation temperature of 540° C.

Since the JIS(AA) 5083 alloy has such excellent properties, it has been used in various fields. However, superplasticity of which the elongation is about 300% is not satisfactory for meeting today's increased working demands.

Japanese Patent Publication No. 30392/1981 (priority, July 20, 1971, U.K. No. 33922; June 27, 1972, U.K. No. 33922), and Japanese Patent Laid-open Publication No. 161045/1980 (priority, July 20, 1971, U.K. 33992/71) disclose superplastic aluminum based alloys, which contain 0.3% to 0.8% of Zr. When Zr is added in an amount greater than 0.25%, the conventional casting process is liable to crystallize a giant compound of Zr with the result that steps of high temperature, and high cooling rate casting are required. Therefore, it is extremely difficult to produce large-sized direct chill (DC) casting slabs to provide problems in the production on an industrial scale.

BRIEF SUMMARY OF THE INVENTION

For the above reasons, the present inventors conducted research to improve the superplasticity, without impairing the excellent properties, of the aforesaid JIS(AA) 5083 alloy which resulted in discovering that the addition of 0.12% to 2% of Cu to the JIS(AA) 5083 alloy makes the grain size finer due to recrystallization promoting effects thereof, and promotes movement and sliding on the grain boundaries to exhibit much improved superplasticity.

The present invention makes it possible to provide a superplastic alloy free of the aforesaid problems in industrial production and capable of producing a large-sized slab, by adding a small amount of Zr.

DETAILED DESCRIPTION OF THE INVENTION

This invention has been made based on the aforesaid findings and provides a superplastic aluminum alloy having a chemical composition consisting of 3.5 to 6% of Mg; at least one of 0.1 to 1% of Mn, 0.05 to 0.35% of Cr, and 0.03 to 0.25% of Zr; 0.12 to 2% of Cu; wherein % means % by weight, and the balance of Al and unavoidable impurities.

The alloy of the present invention may contain unavoidable impurities such as Fe, Si, Zn and the like, and incidental elements such as Ti, B, Be and the like, which are usually added thereto for controlling the cast structure of the aluminum alloy, in an amount described as follows:

Fe: less than 0.5%
Si: less than 0.5%
Zn: less than 0.5%
Bi: less than 0.5%
Sb: less than 0.5%
Ag: less than 0.5%
Ti: less than 0.2%
B: less than 0.05%
Be: less than 0.05%
Pb: less than 0.5%
Sn: less than 0.5%
Ge: less than 0.5%
V: less than 0.2%
Nb: less than 0.2%
Ta: less than 0.2%
Ni: less than 0.2%
Cd: less than 0.2%

Rare earth elements: less than 0.25%, provided that the total amount of the aforesaid elements is preferably less than 1%.

The aluminum alloy of the present invention is cast into a slab by the conventional direct chill (DC) casting, the slab is then subjected to a homogenizing treatment under heating at a temperature of from 450° to 530° C. for, to 48 hours, the resulting slab is then subjected to hot rolling at a temperature of from 250° to 530° C. and at a reduction rate higher than 30% to form a hot rolled plate followed by being subjected to cold rolling at a reduction rate higher than 40% to obtain a cold rolled plate having a final thickness. The homogenizing treatment is preferably carried out by gradually heating up to the treating temperature at a heating rate of from 10° to 200° C./hr, whereby the resulting superplasticity is improved compared with the homogenizing treatment by the conventional heating rate because of more uniform distribution of finer precipitates of Mn, Cr and Zr.

In the case of the aluminum alloy of the present invention, recrystallization takes place during heating to the deformation processing temperature or during deformation processing in the superplastic formation, and a recrystallization treatment for imparting superplasticity is not always needed.

The meanings of the limitations to an amount to be used of respective components in the composition of the aluminum alloy of the present invention are explained as follows: (a) Mg The magnesium component has such functions as to make grain sizes finer to improve the superplasticity, the strength of the alloy, and to corrosion resistance. However, when the content thereof is less than 3.5%, a satisfactory effect due to the aforesaid functions cannot be obtained. On the other hand, when the content thereof is greater than 6%, deterioration in hot and cold workability takes place. Therefore, the content of magnesium is determined in the range of from 3.5 to 6%.

(b) Mn, Cr, and Zr

These components have such functions as to make the cast structure finer, to precipitate uniformly and finely from a stock in the form of a supersaturated solid solution during the homogenizing treatmenent or hot processing thereby to inhibit recovery and recrystallization of the grain and to make the recrystallized grains finer. However, when the content of Mn is less than 0.1%, that of Cr is less than 0.05%, and that of Zr is less than 0.03%, a satisfactory effect due to the aforesaid functions cannot be obtained. On the other hand, when the content of Mn is greater than 1%, that of Cr is greater than 0.35%, and that of Zr is greater than 0.25%, giant intermetalic compounds are easily crystallized particularly in the case of a large-sized slab, resulting in deterioration in superplasticity. Therefore, the contents of these elements are determined in such ranges as to be 0.1 to 1% of Mn, 0.05 to 0.35% of Cr, and 0.03 to 0.25% of Zr, respectively.

(c) Cu

The copper component has such functions as to make grains finer due to its recrystallization promoting effect and to promote the movements and slidings of the grains to remarkably improve the superplasticity, and has such an effect as to shift the optimum deformation temperature to a lower side. However, when the content of Cu is less than 0.12%, it is impossible to obtain excellent superplasticity as required. On the other hand, when the content thereof is higher than 2%, hot and cold processings are made difficult to be performed. Therefore, the content of Cu is determined in the range of from 0.12 to 2%.

The aluminum alloy of the present invention is explained in detail by the following Example:

EXPLANATION OF EXAMPLE

Aluminum alloys 1 to 18 of the present invention and comparative aluminum alloys 1 to 6 having a composition consisting of the components shown in Table 1 were prepared by the conventional direct chill (DC) casting process and casted to form a slab. The slab was gradually heated to 500° C. at a heating rate of 100° C./hr, and was subjected to homogenizing treatment under a condition of keeping at that temperature for 4 hours. Thereafter, the resulting slab was subjected to hot rolling at an initial rolling temperature of 480° C. to form a hot rolled plate having a thickness of 8 mm, and the hot rolled plate was then subjected to cold rolling under conventional conditions to form a cold rolled plate having a final thickness of 1.6 mm.

TABLE 1

| Types of Alloys | | Composition of Alloys (% by weight) | | | | | | Total Elongation |
|---|---|---|---|---|---|---|---|---|
| | | Mg | Mn | Cr | Zr | Cu | Al | (%) |
| Aluminum Alloys of the Present Invention | 1 | 3.53 | 0.53 | — | — | 1.03 | balance | 340 |
| | 2 | 3.95 | 0.56 | — | — | 1.06 | balance | 580 |
| | 3 | 5.92 | 0.58 | — | — | 1.08 | balance | 700 |
| | 4 | 5.03 | 0.13 | — | — | 1.04 | balance | 330 |
| | 5 | 4.99 | 0.97 | — | — | 0.96 | balance | 740 |
| | 6 | 4.91 | — | 0.052 | — | 1.04 | balance | 330 |
| | 7 | 5.03 | — | 0.203 | — | 0.96 | balance | 500 |
| | 8 | 4.96 | — | 0.346 | — | 0.98 | balance | 560 |
| | 9 | 4.98 | — | — | 0.032 | 1.03 | balance | 330 |
| | 10 | 5.01 | — | — | 0.136 | 0.94 | balance | 550 |
| | 11 | 5.04 | — | — | 0.243 | 0.95 | balance | 590 |
| | 12 | 4.54 | 0.68 | 0.163 | — | 1.01 | balance | 770 |
| | 13 | 4.86 | — | 0.214 | 0.126 | 0.93 | balance | 550 |
| | 14 | 5.02 | 0.43 | 0.168 | 0.116 | 0.99 | balance | 630 |
| | 15 | 5.04 | 0.53 | — | — | 0.122 | balance | 340 |
| | 16 | 4.56 | 0.62 | 0.164 | — | 0.13 | balance | 360 |
| | 17 | 4.61 | 0.66 | 0.160 | — | 0.58 | balance | 540 |
| | 18 | 4.58 | 0.67 | 0.161 | — | 1.97 | balance | 800 |
| Comparative Aluminum Alloys | 1 | 3.31* | 0.56 | — | — | 1.02 | balance | 270 |
| | 2 | 4.99 | —* | —* | —* | 0.96 | balance | 180 |
| | 3 | 5.02 | 1.21* | — | — | 0.98 | balance | 240 |
| | 4 | 5.00 | — | 0.365* | — | 1.01 | balance | 250 |
| | 5 | 4.96 | — | — | 0.275* | 0.98 | balance | 220 |
| | 6 | 4.59 | 0.65 | 0.164 | — | —* | balance | 310 |

A high temperature tensile deformation test was made on the cold rolled plates of the aluminum alloys 1 to 18 of the present invention and of the comparative aluminum alloys 1 to 6 obtained as above at a deformation temperature of 530° C., a time for heating to the deformation temperature of 10 minutes, and at an initial strain rate of $1.1\times10^{-3}$/sec to determine the total elongation from the standpoint of evaluating superplasticity. The results thus obtained are also shown in Table 1.

The results of Table 1 show that the aluminum alloys 1 to 18 of the present invention have such excellent superplasticity as to have an elongation higher than 330%, and particularly that the extraplastic properties are remarkably improved by adding Cu as a composition of the alloy by comparison with the aluminum alloys 12, and 16 to 18 of the present invention, which have about the same composition as that of the comparative aluminum 6 except for containing Cu, with the comparative aluminum alloy 6 which corresponds to the conventional JIS(AA) 5083 alloy. As seen in the comparative aluminum alloys 1 to 5, it is apparent that when the content of any one of the components (indicated by * in table 1 (part 2)) is outside the range defined in the present invention, excellent superplasticity as required cannot be obtained.

As described above, the aluminum alloy of the present invention has much better superplasticity compared with the JIS(AA) 5083 alloy, and can be easily produced.

What is claimed is:

1. A superplastic aluminum alloy exhibiting an elongation greater than 310% and consisting of, by weight, 3.5–6% Mg, 0.12–2% Cu, at least one of the following: 0.1–1% Mn, 0.05–0.35% Cr, 0.03–0.25% Zr, balance Al and incidental impurities, said superplastic aluminum alloy being the product of a process in which the alloy components are direct-chill cast to form an ingot, said ingot is subjected to a homogenizing heat-treatment at a temperature of 450°–530° C. for to 48 hours, followed by hot rolling at a temperature of 250°–530° C. and at a reduction rate greater than 30% to form a hot-rolled plate, said plate is subjected to cold rolling at a reduction rate greater than 40% to form a cold-rolled plate.

2. The aluminum alloy of claim 1 consisting of, by weight:

3.5 to 6 percent magnesium;
0.12 to 2 percent copper;
0.1 to 1 percent manganese;
balance aluminum and incidental impurities.

3. The aluminum alloy of claim 1 consisting of, by weight:

3.5 to 6 percent magnesium;
0.12 to 2 percent copper;
0.05 to 0.35 percent chromium;
balance aluminum and incidental impurities.

4. The aluminum alloy of claim 1 consisting of, by weight:

3.5 to 6 percent magnesium;
0.12 to 2 percent copper;
0.03 to 0.25 percent zirconium;
balance aluminum and incidental impurities.

5. The aluminum alloy of claim 1 consisting of, by weight:

3.5 to 6 percent magnesium;
0.12 to 2 percent copper;
0.1 to 1 percent manganese;
0.05 to 0.35 percent chromium;
balance aluminum and incidental impurities.

6. The aluminum alloy of claim 1 consisting of, by weight:

3.5 to 6 percent magnesium;
0.12 to 2 percent copper;
0.05 to 0.35 percent chromium;
0.03 to 0.25 percent zirconium;
balance aluminum and incidental impurities.

7. The aluminum alloy of claim 1 consisting of, by weight:

3.5 to 6 percent magnesium;
0.12 to 2 percent copper;
0.1 to 1 percent manganese;
0.03 to 0.25 percent zirconium;
balance aluminum and incidental impurities.

8. The aluminum alloy of claim 1 consisting of, by weight:

3.5 to 6 percent magnesium;
0.12 to 2 percent copper;
0.1 to 1 percent manganese;
0.05 to 0.35 percent chromium;
0.03 to 0.25 percent zirconium;
balance aluminum and incidental impurities.

9. A superplastic aluminum alloy exhibiting an elongation greater than 310% and consisting of, by weight, 3.5–6% Mg, 0.12–2% Cu, at least one of the following: 0.1–1% Mn, 0.05–0.35% Cr, 0.03–0.25% Zr, balance Al and incidental impurities, said superplastic aluminum alloy being the product of a process in which the alloy components are direct-chill cast to form an ingot, said ingot is subjected to a homogenizing heat-treatment by gradually heating the ingot at a rate of 19°–200° C./hour and heat-treating it at a temperature of 450°–530° C. for to 48 hours, followed by hot rolling at a temperature of 250°–530° C. and at a reduction rate greater than 30% to form a hot-rolled plate, said plate is subjected to cold rolling at a reduction rate greater than 40% to form a cold-rolled superplastic alloy.

10. A method of producing a superplastic aluminum base alloy exhibiting an elongation greater than 310% and consisting of, by weight, 3.5–6% Mg, 0.12–2% Cu, at least one of the following: 0.1–1% Mn, 0.05–0.35% Cr, 0.03–0.25% Zr, balance Al and incidental impurities, comprising the steps of direct-chill casting the alloy components to form an ingot, subjecting said ingot to homogenizing heat-treatment at a temperature of 450°–530° C. for to 48 hours, hot rolling the homogenized ingot at a temperature of 250°–530° C. and at a reduction rate greater than 30% to form a hot-rolled plate, cold rolling said plate at a reduction rate greater than 40% to form a cold-rolled superplastic alloy.

11. The method of claim 10, wherein said homogenizing heat-treatment is carried out by gradually heating said ingot to said heat-treatment temperature at a rate of 10°–200° C./hour.

* * * * *